United States Patent [19]

Schroeder

[11] Patent Number: 4,977,300

[45] Date of Patent: Dec. 11, 1990

[54] DISPENSER SWITCH

[76] Inventor: Alfred A. Schroeder, 2811 Whisper Fawn, San Antonio, Tex. 78230

[21] Appl. No.: 439,487

[22] Filed: Nov. 21, 1989

[51] Int. Cl.[5] ..... H01H 13/14

[52] U.S. Cl. ..... 200/293; 200/341; 200/331; 200/302.2

[58] Field of Search ..... 200/294, 296, 309, 302.2, 200/330, 331, 341, 344, 517, 293, 61.58 R, 61.62, 302.1

[56] References Cited

U.S. PATENT DOCUMENTS

| | | | |
|---|---|---|---|
| 3,721,926 | 3/1973 | Berenbaum et al. | 200/330 X |
| 3,978,297 | 8/1976 | Lynn et al. | 200/517 X |
| 4,045,629 | 8/1977 | anzani | 200/293 X |
| 4,0-59,737 | 11/1977 | Gergaud | 200/302.2 X |
| 4,293,764 | 10/1981 | Amrhein | 200/302.2 |
| 4,377,049 | 3/1983 | Simon et al. | 200/309 X |

FOREIGN PATENT DOCUMENTS

| | | | |
|---|---|---|---|
| 683776 | 4/1964 | Canada | 200/331 |
| 783141 | 4/1968 | Canada | 200/302.2 |
| 0928437 | 5/1982 | U.S.S.R. | 200/330 |

*Primary Examiner*—Ernest G. Cusick

*Attorney, Agent, or Firm*—Cox & Smith Incorporated

[57] ABSTRACT

A switch system for soda fountain dispensers which incorporates an actuating member in membrane switches for soda fountain dispensers. The actuating member is incorporated in a pressure sensitive membrane switch which facilitates access into the interior of soda fountain dispenser heads for ease of maintenance and adjustment of concentrations of soda water and syrup.

3 Claims, 2 Drawing Sheets

DISPENSER SWITCH

BACKGROUND OF THE INVENTION

This invention relates to switches for soda fountain dispensers and, more particularily, but not by way of limitation, to an activating member for switches in conventional soda fountain dispensers.

Pressure-sensitive buttons that activate switches by minimal fingertip pressure are readily available in the soda fountain dispenser industry. Such buttons are ordinarily comprised of a thin sheet with a flexible membrane centered and affixed onto the surface of the sheet. The sheet with the flexible membrane is mounted onto the outer surface of a molded face plate, and the plate, in turn, is mounted onto the head of a soda fountain dispenser. An ordinary electric switch is mounted onto the inner surface of the molded face plate such that the switch is situated immediately behind the flexible membrane and located inside the head of the soda fountain dispenser.

The electric switch is not connected to the flexible membrane, but is positioned extremely close (between 0.003 to 0.005 inch) to the membrane. This close proximity allows the connection of the electrical circuit with minimal pressure exerted by an operator's finger placed upon the flexible membrane of the pressure-sensitive button.

Because the flexible membrane and the switch have to be aligned in such close proximity, the overall structure has to necessarily be mounted onto a single molded plate. The required minimal distance between the membrane and the switch cannot be constantly maintained if the two are mounted on separate structures. The two elements have to be positioned at a constant distance of around 0.004 inch from each other, something that could only be achieved, prior to this invention, by mounting the pressure-sensitive button onto the outer surface of a molded plate and the electric switch onto the inner surface of the same molded plate.

Since the pressure-sensitive button and the electric switch have to be mounted onto a single molded face plate, the plate cannot be removed from the head of a soda fountain dispenser without disconnecting the electric wiring connecting the switch to the internal circuitry within the head of the soda fountain dispenser. This prevents the installation of an easily removable molded face plate.

If the molded face plate has to be removed (for example, to gain access to the interior of the dispenser head to adjust soda water to syrup ratio), the internal wiring connecting the switch within the dispenser head has to be disconnected. The face plate cannot be removed without concurrent disconnection of the electric switch.

Thus, the disadvantage of conventional pressure-sensitive buttons for soda fountain dispensers is that any adjustment or repairs that have to be conducted within the interior of the dispenser head requires the dismantling of the face plate on which the pressure-sensitive button is mounted and the disconnection of the wiring to the internal switch. This is the reason maintenance of the heads of conventional soda fountain dispenser switches is time-consuming and a drain on valuable manpower.

There is a need for a device which can facilitate maintenance of the interior of soda fountain dispenser heads by providing easily removable face plates with pressure-sensitive buttons without cumbersome dismounting and disconnection of electric circuitry.

This invention provides such a device and overcomes the aforementioned shortcomings of conventional soda fountain dispenser switches by providing an activating member which can easily be incorporated into available pressure-sensitive buttons. The novel activating member of the present invention allows for removable face plates that can be removed without disconnection of electric circuitry connecting the internal switch of the dispenser heads.

SUMMARY OF THE INVENTION

This invention allows for the mounting of an electric switch onto the interior of a soda fountain dispenser head housing and the separate mounting of a pressure-sensitive button onto a separate removabale molded face plate. The separation of the two portions of the pressure-activated switch system allows for a removable face plate, negating the need for a break in internal wiring while still maintaining the required minimal distance between the flexible membrane of the pressure-sensitive button and the electric switch.

The above is accomplished by placing an actuating member between the flexible membrane and the internal electric switch such that the actuating member is in direct contact with and mounted immediately behind the membrane. The actuating member is of variable length such that an actuating member of a precise length is selected in accordance with the precise distance measured between the membrane and the electric switch on a given soda fountain dispenser head. The selected actuating member must be of a length such that when it is affixed to a flexible membrane the tip of the actuating member is within 0.004 inch from the electric switch when the face plate is aligned and placed onto the outer face of the soda fountain dispenser switch housing.

This construction allows an operator to activate the pressure-sensitive button with minimal digital pressure while also permitting easy removal of the molded face plate allowing subsequent access to the interior of a soda fountain dispenser switch housing. The placement of the tip of the actuating member within 0.003 to 0.005 inch off the electric switch permits the use of minimal pressure-sensitive buttons, and the separate mounting of the flexible membrane and the actuating member on separate elements allows for a removable face plate without cumbersome dismantling or dissconnection of wiring to the switch. Because of the easy access, the removable face plate allows easy, time-saving maintenance of the interior of the switch housing.

Other objects, features and advantages of this invention will become evident in light of the following description of the invention.

DETAILED DESCRIPTION OF THE PREFERRED EMBODIMENT

Figure 1:
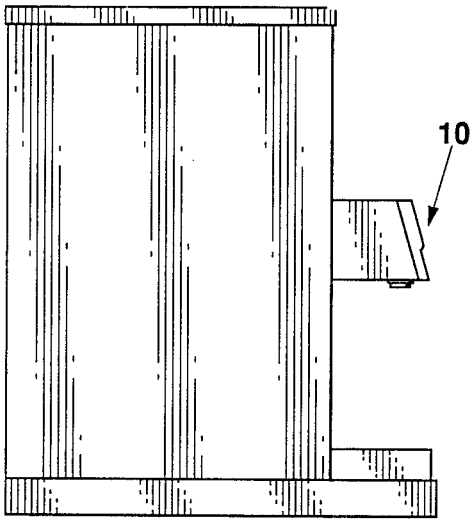
FIG. 1 depicts a side view of a conventional soda fountain dispenser with the dispenser switch housing depicted generally by the numeral 10.
Figure 4:
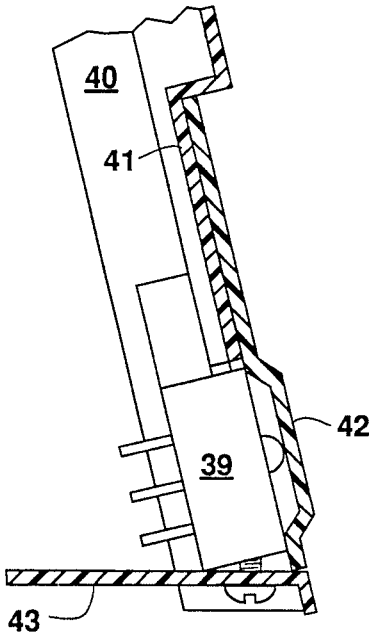
Fig. 4 PRIOR ART
FIG. 4 is a side, cutaway view of a conventional pressure activated switch system. Electric switch 39 is mounted to both the floor of the dispenser switch housing 43 and to vacuum-formed face plate 40. This dual mounting allows for the close proximity between switch 39 and flexible membrane 42 to be maintained.

FIG. 1 shows a general application for the present invention, a side view of a conventional soda fountain dispenser with the dispenser switch housing depicted by the numeral 10. An example of a pressure sensitive button system, currently available for such conventional soda fountain dispensers, is depicted in FIG. 4. FIG. 4 shows a side, cutaway view of a conventional pressure activated switch system. Electric switch 39, is mounted directly onto vacuum-formed face plate 40. Close proximity, of approximately 0.004 inch, is maintained between switch 39, and flexible membrane 42. Only minimal digital pressure exerted on flexible membrane 42 is required to activate switch 39 to dispense soda from the fountain head. However, prior to the present invention, face plate 40 could not be removed from housing 43 because switch 39, was permanently connected to electrical wiring and also attached to face plate 40. Removal of face plate 40 necesarilly required disconnection of the electrical wiring.

Figure 5:
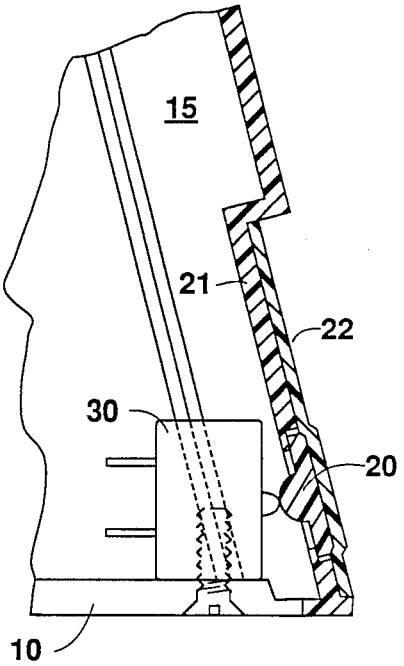
FIG. 5 depicts a side, cutaway view of the pressure sensitive switch system of the present invention. Electric switch 30 is shown mounted solely to the floor of dispenser switch housing 10. Vaccuform face plate 15 independantly holds actuating member 20 with thin sheet member 21. Close proximity between flexible membrane 22 and switch 30 is maintained by actuating member 20.

FIG. 5 depicts a side, cutaway view of the pressure sensitive switch system of the present invention. Electric switch 30 is shown mounted solely to the floor of dispenser switch housing 10. Vaccuform face plate 15 independantly holds actuating member 20 with thin sheet member 21. Close proximity, around 0.003 to 0.005 inch, between flexible membrane 22 and switch 30 is maintained by actuating member 20. Since there is no physical connection with electric switch 30, face plate 15 can be removed with ease and replaced with confidence, knowing that actuating member 20 will maintain the required microscopic distances between switch 30 and the contiguous connection to flexible membrane 22.

Figure 2:
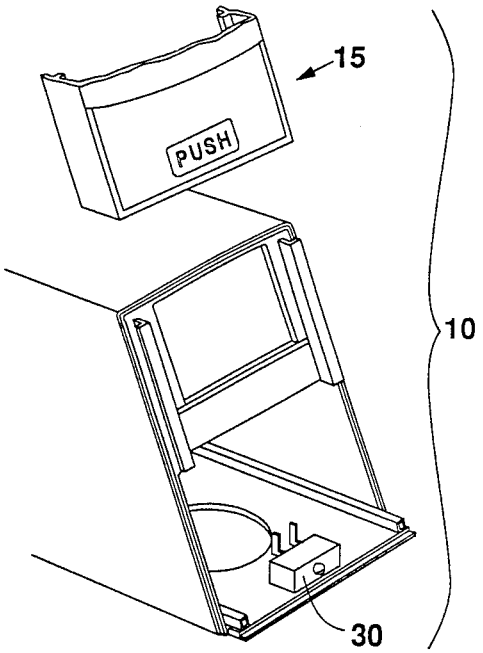
FIG. 2 is a perspective view into the interior of the dispenser switch housing 10 showing the mounting of electric switch 30 on the floor of said switch housing 10. Also depicted is vacuum-form face plate 15 shown in an open configuration.
Figure 3:
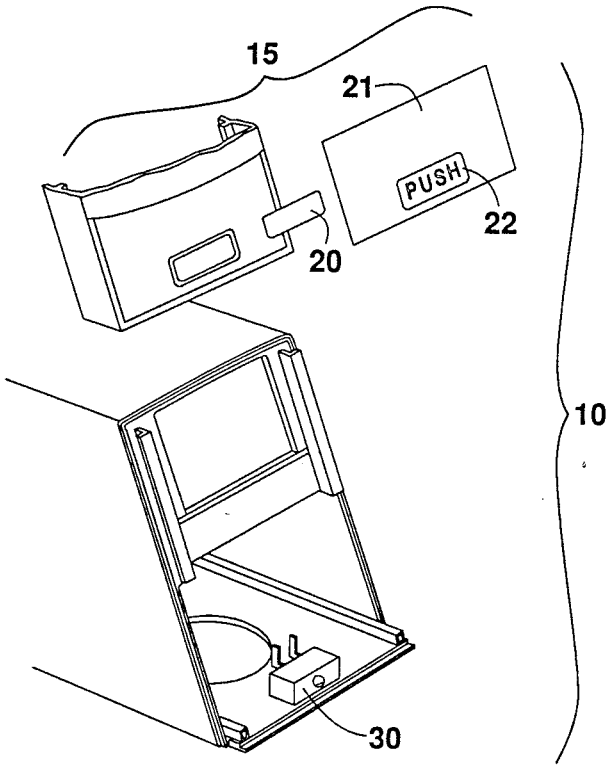
FIG. 3 depicts an exploded view of the molded face plate 15 showing the component parts which comprise the pressure sensitive button of the present invention, namely, an actuating member 20, a thin sheet member 21, and affixed onto said thin sheet member 21, a flexible membrane 22.

FIG. 2 is a perspective view into the interior of the dispenser switch housing 10 showing the mounting of electric switch 30 on the floor of said switch housing 10. Vaccuform face plate 15 is shown in an open configuration. FIG. 3 depicts an exploded view of the molded face plate 15 showing the component parts which comprise the pressure sensitive button system of the present invention. Actuating member 20 is mounted onto face plate 15 with thin sheet member 21. Affixed onto said thin sheet member 21 is flexible membrane 22 which appears as a button on the surface of the thin sheet.

Figure 6:
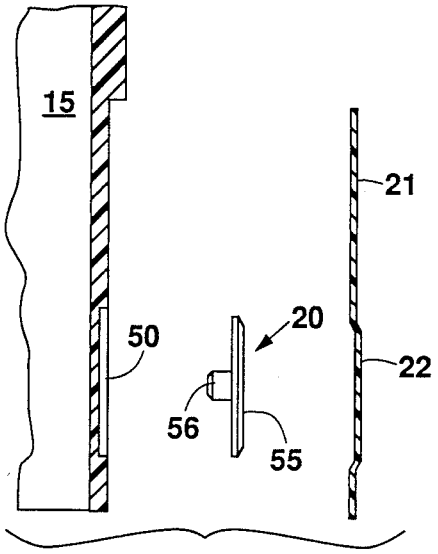
FIG. 6 depicts an exploded side view of the pressure sensitive button system of the present invention showing component parts actuating member 20, thin sheet member 21, affixed onto said thin sheet 21, flexible membrane 22, and molded face plate 15, onto which the system is mounted.

FIG. 6 shows another view of the pressure sensitive button system of the present invention showing component parts, from left to right, molded face plate 15; insertable into face plate 15, actuating member 20; and thin sheet member 21 which has, as an integral part thereof, a flexible membrane 22, said thin sheet 21 adhesively covers and holds firmly in place actuating member 20 on face plate 15. Molded face plate 15 has a recess 50 which is designed to have actuating member 20 insertable therein. Actuating member 20 is comprised of planar base 55 and perpendicularly protruding tip 56.

What is claimed is:

1. A pressure-sensitive, electrical button switch system for soda fountain dispenser heads, comprising:

an electrical switch adapted to be mounted onto a dispenser switch housing;

a molded face plate with a recess removably and replaceably attached to said dispenser switch housing;

an actuating member inserted into said recess of said face plate; and a thin sheet member with a flexible membrane adhesively mounted onto said face plate such that said actuating member is held firmly within said recess with said flexible membrane resting immediately adjacent said actuating member, and said actuating member maintained at a distance of 0.003 to 0.005 inch from said electric switch.

2. The pressure-sensitive, electrical button switch system of claim 1 wherein said actuating member is comprised of a planar base with a perpendicularly protruding tip; said tip maintained at a distance of 0.004 inch from said electric switch.

3. The pressure-sensitive, electrical button switch system of claim 1 wherein said molded face plate is removable from said dispenser switch housing to provide easy access to the interior of said housing.

* * * * *